United States Patent [19]

Eldib

[11] 3,950,260

[45] Apr. 13, 1976

[54] POLYACRYLATES OF SELECTIVE VISCOSITY AS DETERGENT BUILDERS

[76] Inventor: Ibrahim Andrew Eldib, 22 Beekman Terrace, Summit, N.J. 07087

[22] Filed: Apr. 10, 1972

[21] Appl. No.: 242,690

Related U.S. Application Data

[63] Continuation-in-part of Ser. No. 689,107, Jan. 16, 1968, abandoned.

[52] U.S. Cl. ..... 252/89 R; 252/DIG. 2; 260/80 R

[51] Int. Cl.[2] ..... C11D 3/37

[58] Field of Search ..... 252/89, DIG. 2; 260/80 R

[56] References Cited

UNITED STATES PATENTS 3,308,067 3/1967 Diehl ..... 252/DIG. 2

3,623,991 11/1971 Sabatelli ..... 252/DIG. 2

OTHER PUBLICATIONS

Schwartz et al., Surface Active Agents, Vol. I, 1963 (1949), pp. 234, 235, Interscience Publ. Inc.

*Primary Examiner*—William E. Schulz

[57] ABSTRACT

Water soluble polyacrylates and salts of polyacrylates having selected viscosities measured in terms of a 12.5 wt. percent aqueous solution of the 100 percent sodium salt at room temperature (72°F.) are very effective detergent builders in heavy duty solid detergents and in liquid detergents. Detergents formulated from them have excellent chelating ability for heavy metal ions, excellent cotton detergency, good dishwashing ability and foam stability.

11 Claims, 1 Drawing Figure

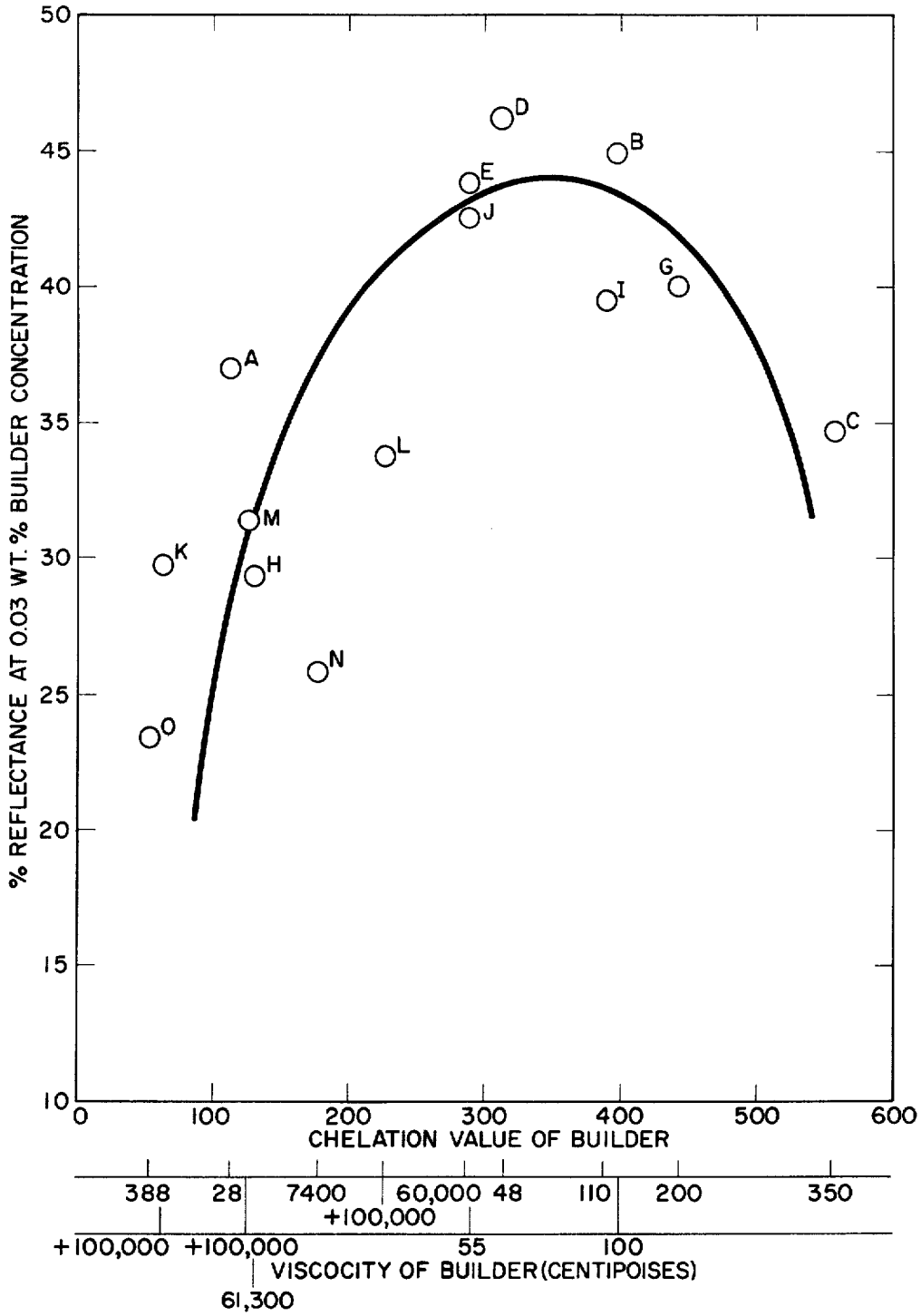
% REFLECTANCE AT 0.03 WT.% BUILDER CONCENTRATION
50
45
40
35
30
25
20
15
10
0
100
200
300
400
500
600
CHELATION VALUE OF BUILDER
A
B
C
D
E
G
H
I
J
K
L
M
N
O
388
28
7400
60,000
48
110
200
350
+100,000
+100,000
+100,000
55
100
VISCOCITY OF BUILDER (CENTIPOISES)
61,300

POLYACRYLATES OF SELECTIVE VISCOSITY AS DETERGENT BUILDERS

CROSS REFERENCE TO RELATED APPLICATION

This application is a continuation-in-Part of Ser. No. 698,107, filed Jan. 16, 1968 and now abandoned.

BACKGROUND OF INVENTION

The property possessed by some materials of improving detergency levels of soaps and synthetic detergents and the use of such materials in detergent compositions is known. Such cleaning boosters are called "builders." Builders permit the attainment of superior cleaning performance both as regards quality of finished work and lower cost, than is possible when so-called unbuilt compositions are used.

The behavior and mechanism by which builders perform their function is not fully understood although several explanations for their behavior are available. Nevertheless, an unequivocal criterion does not exist which would permit one to predict accurately which class of compounds possess valuable builder properties and which compounds do not.

This may be explained in part by the complex nature of detergency and the countless factors which contribute to overall performance results. Builder compounds have been found to have some effect, for instance, in such areas as stabilization of solid soil suspension, emulsification of soil particles, the surface activity of aqueous detergent solutions, solubilization of water-insoluble materials, foaming or suds producing characteristics of the washing solution, peptization of soil agglomerates, neutralization of acid soil, and the inactivation of mineral constituents present in the washing solution. Thus, any theoretical discussion of the boosting capacity of a builder compound should give due consideration to all the significant individual actions involved in the detergent process and must apply equally to all usual conditions of soiling and washing.

Examples of know builder materials are water-soluble inorganic alkaline builder salts which can be used alone or in combination, including alkali metal carbonates, borates, phosphates, bicarbonates and silicates. Examples of know organic builder materials are alkali metal, ammonium or substituted ammonium aminopolycarboxylates, e.g. sodium and potassium ethylenediaminetetraacetate, sodium and potassium N(2-hydroxyethyl)-ethylenediaminetriacetate, sodium and potassium and triethanolammonium-N-(2-hydroxyethyl)-nitrilodiacetate. Alkali metal salts of phytic acid, e.g. sodium phytate, are also suitable as organic builders.

SUMMARY OF THE INVENTION

It has been discovered that certain water soluble derivatives of acrylic acid homopolymers particularly their water soluble salts impart surprisingly outstanding building power to heavy-duty (used in water solutions at temperatures between about 120° and 200° F.) solid laundry detergents and light-duty (used in water solutions at temperatures below about 100° F.) liquid dishwashing and hand laundry formulations. They can be used but are not as effective in other types of detergent formulations. The preferred polymer builders have a chelation value of at least about 75 and a viscosity (72° F.) of less than about 500 centipoises (12.5 wt. percent aqueous solution of the 100percent sodium salt of the polymer).

BRIEF DESCRIPTION OF THE DRAWING

The sole FIGURE is a graphical representation of the data of Table I hereof.

The homopolymers of the invention are prepared from a monomer having the general formula:

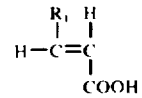

where $R_1$ is a hydrogen atom or methyl radical. While the term homopolymer is used, it is intended that it include by definition polymers that contain small, i.e., 10 mole percent or less, quantities of one or more comonomers.

While the preparation of polyacrylates from acrylic acid and methacrylic acid monomers is well known in the art and need not be detailed here, the following will illustrate the general technique that can be used.

The polymerization of acrylic acid to polyacrylate acid can be stopped at any appropriate molecular weight (determined by viscosity). The conditions under which it is polymerized will result in different performance characteristics for similar molecular weight polymers. If, for example, the polymerization took place under a condition of a high temperature (100°–150° C.), there will be a strong tendency for crosslinking to occur. Crosslinking decreases the apparent acid strength of the polyacid by preventing the expansion of the molecules, which would otherwise increase the separation between carboxylic groups. This results in two distinct results. First, the solubility of the polymer is reduced, and secondly the chelation ability is reduced. It should be noted that the higher molecular weight the more likely extensive crosslinking occurs. It has, however, been possible to produce polyacrylic acid having molecular weights in the billions without extensive crosslinking by reacting the monomers under mild conditions.

Water soluble salts of acrylic acid and methacrylic acid homopolymers described above are especially preferred for the purposes of the invention. The water-soluble salt can be alkali metal, ammonium or substituted (quaternary) ammonium salt. The alkali metal can be sodium or potassium. The salt can be used in a partially or fully neutralized form. Also, partial neutralization and esterification of the carboxylic acid groups can be carried out while still retaining the effective properties of the homopolymer. The homopolymers are converted to the desired salt by reaction with the appropriate base, generally with a stoichiometric excess of the desired percent of conversion. Normally 100 percent of the carboxyl groups present will be converted to the salt, but the percentage can be less in certain situations. In general, the homopolymers of the invention in the acid form before conversion to a salt or ester, will have a molecular weight (Staudinger) of from 30,000 to 1,000,000, preferably 60,000 to 500,000 even more preferably 100,000 to 300,000 and most preferably 100,000 to 200,000.

It is somewhat difficult to establish an absolute value for an upper limit of the degree of polymerization above which the polyacrylic acid and/or polymethacrylic acid builder compounds no longer function as efficient builders. The fact is that practical considerations appear to be the primary determining factor as the degree of polymerization increases. For instance, as the molecular weight of a polymeric material increases, it is generally acknowledged that the water solubility thereof decreases. However, this is only true of a polyelectrolyte if it becomes crosslinked. It is essential to the present invention that the polyelectrolyte builder compounds must be adequately soluble in water under regular usage conditions. Recommended builder concentrations generally range from about 0.01 percent to about 0.50 percent, preferably 0.02 to 0.1 percent, more preferably 0.03 to 0.05 percent by weight of the washing solution. The upper operable limit, therefore, so far as the scope of this invention is concerned, is reached when it is no longer possible to get enough of the builder compound into solution to act as a builder.

For instance, concentrations on the order of 0.02 percent, 0.50 percent, 0.01 percent by weight of the preferred homopolymers will effectively perform under washing conditions such as a water hardness of 21 grains equivalent $CaCO_3$ per gallon or higher. In such situations, any of the polyelectrolyte builder compounds of this invention could be selected whose solubility characteristics would allow a builder concentration in an aqueous solution to the necessary amount. In more general household situation builder concentrations of 0.03 percent to about 0.06 percent by weight of the washing solution are found to be adequate.

It is extremely difficult to accurately determine molecular weights of polymeric compounds. Such figures will generally vary depending upon the method used to determine them. It is widely recognized, for instance, that any molecular weights of polymeric materials which are given by manufacturers constitute an average of the molecular weights of the molecules present. Moreover molecular weight ranges are usually given which vary widely depending again upon the method used to measure the molecular weights. Among the several methods frequently used to measure molecular weights of polymeric compounds are osmometric, end-group, cryoscopic, ebullioscopic, light-scattering, specific viscosity, intrinsic viscosity and ultracentrifuge. Each of these methods are presently in varying degrees of development and each one has special types of polymeric compounds to which it is best adapted.

Viscosity is a property more frequently used by polymer chemists as characterizing polymeric compounds than are molecular weights. This is no doubt due to the comparatively easier and less complicated methods for obtaining viscosity data. To make such data meaningful, it is necessary to also give the test condition under which the measurements were run. Since there is a recognized correlation between the viscosity of polymeric compounds and their relative molecular weights and since such figures can be more meaningful and can frequently be more available than molecular weights, the polymeric builder compounds described and used in the examples of this invention are also characterized in terms of viscosity.

A convenient way chosen to identify and characterize the homopolymers of the invention is in terms of viscosity at room temperature of a water solution of the sodium polymer salts (100 percent Na) containing 12.5 wt. percent of solids. By such a characterization the preferred 100 percent sodium salt polymers of the invention will have a viscosity at 12.5 wt. percent in water at room temperature (72° F.) of less than 500 centipoises, preferably between about 25 to 500 centipoises and most preferably between about 25 to 350 centipoises. Higher viscosity polymers, depending upon the degree to which they may be crosslinked, are also operative builder compositions. However, as noted above, low viscosity polymers are the preferred builder constituents.

The homopolymer builders of the invention are particularly outstanding in terms of their ability to chelate calcium ions. This allows the compositions to serve the important function of chelating calcium so that the water in which the detergent is operating can be softened. Generally, a minimum chelation ability of at least 75 mg. $CaCO_3$/gram of polymer is preferred. Most preferably the acrylic acid or methacrylic acid polymers used have a chelation value (milligrams of $CaCO_3$ per gram polymer) of between about 100 to 500.

The preferred homopolymer builders of the invention imparted outstanding cleaning action to formulations containing the same. The compositions performed better for cotton cleaning than the commonly used builders sodium nitrilotriacetate (SNTA) and sodium tripolyphosphate (STPP) in heavy-duty solids. In light-duty dishwashing liquids the compositions performed better than SNTA and tetrapotassium pyrophosphate (TKPP) in both washing ability and foam stability.

Generally, washing performance is at a maximum at a high level of alkalinity. The commercially used phosphate builders are buffers as well as chelating agents. A further advantage of the homopolymers of the invention is that there is unexpectedly only a very small loss of alkalinity in the wash solution and this can be easily remedied with small amounts of standard builders such as STPP or TKPP. Generally, when phosphates are used with polyacrylate or polymethacrylate salt builders they are present in amounts varying up to 10 wt. percent, preferably 0.01 to 5.0 wt. percent of the total detergent formulation. Because of the role played by phosphates in water pollution, it is most preferred that the detergent formulations of this invention be substantially free of phosphate builder materials.

In general, in the detergent compositions of this invention, the essential ingredients are (a) an organic water soluble detergent surface active material as defined and illustrated below and (b) a novel polyelectrolyte builder compound meeting the requirements specified and exemplified above. The detergent compositions of this invention preferably contain the essential ingredients in a ratio of polyelectrolyte builder to detergent surfactant in the range of about 1:5 to less than about 5:1 by weight, with such compositions providing in aqueous solution a pH of about 9 to about 12 in normal use concentrations. The preferred ratio of polyelectrolyte builder to detergent surfactant is about 1.4 to about 4:1 and the optimum pH range is 9.5 to about 11.5.

The detergent surface active compounds which can be used within the compositions of this invention include anionic, nonionic, zwitterionic, ampholytic detergent compounds and mixtures thereof. Suitable substances are described at length below:

a. Anionic detergent compositions which can be used in the compositions of this invention include both soap and synthetic detergent compounds. Examples of suitable soaps are the sodium, potassium, ammonium and alkylolammonium salts of higher fatty acids ($C_{19}$-$C_{20}$).

Particularly useful are the sodium or potassium salts of the mixtures of fatty acids derived from coconut oil and tallow, i.e., sodium or potassium tallow and coconut soap. Examples of anionic organic non-soap detergent compounds are the water soluble salts, alkali metal salts, of organic sulfuric reaction products having in their molecular structure an alkyl radical containing from about 8 to about 22 carbon atoms and a radical selected from the group consisting of sulfonic acid and sulfuric acid ester radicals. (Included in the term alkyl is the alkyl portion of higher acyl radicals.) Important examples of the synthetic detergents which form a part of the compositions of the present invention are the sodium or potassium alkyl sulfates especially those obtained by sulfating the higher alcohols ($C_8$-$C_{18}$ carbon atoms) produced by reducing the glycerides of tallow or coconut oil; sodium or potassium alkyl benzenesulfonates, such as are described in United States letters Patent Nos. 2,220,009 and No. 2,477,383 in which the alkyl group contains from about 9 to about 15 carbon atoms; other examples of alkali metal alkylbenzene sulfonates are those in which the alkyl radical is a straight or branched chain aliphatic radical containing from about 10 to about 20 carbon atoms for instance, in the straight chain variety 2-phenyl-dodecanesulfonate and 3-phenyl-dodecanesulfonate; sodium alkyl glyceryl ether sulfonates, especially those ethers of the higher alcohols derived from tallow and coconut oil; sodium coconut oil fatty acid monoglyceride sulfates and sulfonates; sodium or potassium salts of sulfuric acid esters of the reaction product of one mole of a higher fatty alcohol (e.g. tallow or coconut oil alcohols) and about 1 to 6 moles of ethylene oxide; sodium or potassium salts of alkylphenol ethylene oxide ether sulfate with about 1 to about 10 units of ethylene oixde per molecule and in which the alkyl radicals contain about 9 to about 12 carbon atoms; the reaction product of fatty acids esterified with isethionic acid and neutralized with sodium hydroxide where, for example, the fatty acids are derived from coconut oil; sodium or potassium salts of fatty acid amide of a methyl tauride in which the fatty acids, for example, are derived from coconut oil; sulfonated polycarboxylic acids derived from pyrolyzed calcium citrate (citrex); and others known in the art.

b. Nonionic synthetic detergents may be broadly defined as compounds aliphatic or alkylaromatic in nature which do not ionize in water solution. For example, well-known class of nonionic synthetic detergents is made available on the market under the trade name of "Pluronic." These compounds are formed by condensing ethylene oxide with a hydrophobic base formed by the condensation of propylene oxide with propylene glycol. The hydrophobic portion of the molecule which, of course, exhibits water insolubility has a molecular weight of from about 1,500 to 1,800. The addition of polyoxyethylene radicals to this hydrophobic portion tends to increase the water solubility of the molecule as a whole and the liquid character of the product is retained up to the point where polyoxyethylene content is about 50 percent of the total weight of the condensation product.

Other suitable nonionic synthetic detergents include:

1. The polyethylene oxide condensates of alkyl phenols, e.g., the condensation products of alkyl phenols having an alkyl group containing from about 6 to 12 carbon atoms in either a straight chain or branched chain configuration, with ethylene oxide, the said ethylene oxide being present in amounts equal to 10 to 25 moles of ethylene oxide per mole of alkyl phenol. The alkyl substituent in such compounds may be derived from polymerized propylene, diisobutylene, octene, or nonene, for example.

2. Those derived from the condensation of ethylene oxide with the product resulting from the reaction of propylene oxide and ethylene-diamine or from the product of the reaction of a fatty acid with sugar, starch or cellulose. For example, compounds containing from about 40 percent to about 80 percent polyoxyethylene by weight and having a molecular weight of from about 5,000 to about 11,000 resulting from the reaction of ethylene oxide groups with a hydrophobic base constituted of the reaction product of ethylene diamine and excess propylene oxide, and hydrophobic bases having a molecular weight of the order of 2,500 to 3,000 are satisfactory.

3. The condensation product of aliphatic alcohols having from 8 to 18 carbon atoms, in either straight chain or branched chain configuration, with ethylene oxide e.g. a coconut alcohol-ethylene oxide condensate having from 10 to 30 moles of ethylene oxide per mole of coconut alcohol, the coconut alcohol fraction having from 10 to 14 carbon atoms.

4. Long chain tertiary amine oxides corresponding to the following general formula, $R_1R_2R_3N \rightarrow O$, wherein $R_1$ is an alkyl radical of from about 8 to 18 carbon atoms, and $R_2$ and $R_3$ are each methyl or ethyl radicals. The arrow in the formula is a conventional representation of a semipolar bond. Examples of amine oxides suitable for use in this invention include dimethyldodecylamine oxide, dimethyloctylamine oxide, dimethyldecylamine oxide, dimethyltetradecylamine oxide, dimethylhexadecylamine oxide.

5. Long chain tertiary phosphine oxides corresponding to the following formula $RR'R''P \rightarrow O$, wherein R is an alkyl, alkenyl or monohydroxyalkyl radical ranging from 10 to 18 carbon atoms in chain length and R' and R'' are each alkyl or monohydroxyalkyl groups containing from 1 to 3 carbon atoms. The arrow in the formula is a conventional representation of a semipolar bond. Examples of suitable phosphine oxides are:

dimethyldodecylphosphine oxide,
dimethyltetradecylphosphine oxide,
ethylmethyltetradecylphosphine oxide,
cetyldimethylphosphine oxide,
dimethylstearylphosphine oxide,
cetylethylpropylphosphine oxide,
diethyldodecylphosphine oxide,
diethyltetradecylphosphine oxide,
bis(hydroxymethyl) dodecylphosphine oxide,
bis(2-hydroxyethyl) dodecylphosphine oxide,
2-hydroxypropylmethyltetradecylphosphine oxide,
dimethyloleylphosphine oxide, and
dimethyl-2-hydroxydodecylphosphine oxide. 6. Dialkyl sulfoxides corresponding to the following formula, $RR'S \rightarrow O$, wherein R is an alkyl, alkenyl, beta- or gamma-monohydroxyalkyl radical or an alkyl or beta- or gamma-monohydroxyalkyl radical containing one or two other oxygen atoms in the chain, the R groups ranging from 10 to 18 carbon atoms in chain length, and wherein R' is methyl or ethyl. Examples of suitable sulfoxide compounds are:

dodecylmethylsulfoxide
tetradecylmethylsulfoxide
3-hydroxytridecyl methyl sulfoxide 2-hydroxydodecyl methyl sulfoxide
3-hydroxy-4-decoxybutyl methyl sulfoxide
3-hydroxy-4-dodecoxybutyl metal sulfoxide
2-hydroxy-3-decoxypropyl methyl sulfoxide
2-hydroxy-3-dodecoxypropyl methyl sulfoxide
dodecyl ethyl sulfoxide
2-hydroxydodecylethylsulfoxide The 3-hydroxy-4-decoxybutyl methyl sulfoxide has been found to be an especially effective detergent surfactant. An outstanding detergent composition contains this sulfoxide compound in combination with the polyacrylic acid builder compound of this invention.

7. Fatty acid esters of sugars, starch or cellulose.

c. Ampholytic synthetic detergents can be broadly described as derivatives of aliphatic secondary and tertiary amines in which the aliphatic radical may be straight chain or branched and wherein one of the aliphatic substituents contains from about 8 to 18 carbon atoms and one contains an anionic water solubilizing group. Examples of compounds falling within this definition are sodium-3-dodecylaminopropionate and sodium-3dodecylaminopropanesulfonate.

d. Zwitterionic synthetic detergents can be broadly described as derivatives of aliphatic quarternary ammonium compounds in which the aliphatic radical may be straight chain or branched andd wherein one of the aliphatic substituents contains from about 8 to 18 carbon atoms and one contains an anionic water solubilizing group. Examples of compounds falling within this definition are 3-(N,N-dimethyl-N-hexadecylammonio) propane-1-sulfonate and 3-(N,N-dimethyl-N-hexadecylammonio)-2-hydroxypropane-1-sulfonate which are especially preferred for their excellent cool water detergency characteristics.

The anionic, nonionic, ampholytic and zwitterionic detergent surfactants mentioned above can be used singly or in combination in the practice of the present invention. The above examples are merely specific illustrations of the numerous detergents which can find application within the scope of this invention.

A granular detergent composition can contain a polyelectrolyte builder of this invention and a detergent surfactant in the weight ratio of about 1:5 to less than about s:1. The preferred weight ratio of builder to surfactant is about 1.4 to about 4:1. Another embodiment of this invention is a built liquid detergent composition containing a polyelectrolyte builder described above and a detergent surfactant in a ratio of builder to detergent of about 1.4 to less than about 5:1. The preferred ratio for built liquid compositions of polyelectrolyte builder to detergent is about 1:4 to about 3:1.

The detergent compositions described by this invention employing a polyelectrolyte builder compound as defined above also have special applicability in the area of light duty built liquid detergents. This area presents special problems to the formulator in view of the peculiarities inherent in aqueous systems and the special requirements of solubility of the ingredients and, more especially their stability in such mediums. It is well known, for instance, that sodium tripolyphosphate, while outstanding in its behavior in granular compositions, is generally regarded as being unsuited for built liquid detergents, because of its propensity to hydrolyze into lower forms of phosphates. Thus, as a practical consideration there has been a necessity of resorting to alkali metal pyrophosphates, such as $K_4P_2O_7$, in order to prepare a built liquid detergent. This has been true notwithstanding the known inferiority of pyrophosphates to sodium tripolyphosphate in some compositions, for example, as a builder for heavy duty detergency.

In view of the increasing acceptance by the general public of built liquid detergents for dishwashing it is very significant and a featured contribution of this invention that an improved liquid detergent product is now possible that will provide detergent levels superior to a sodium tripolyphosphate built liquid product without the troublesome stability problem presented by sodium tripolyphosphate.

Most of the built liquid detergents commercially available at the present time are either water based or have a mixture of water and alcohol as the liquid vehicle. Such vehicles can be employed in formulated built liquid detergent compositions according to this invention without fear of encountering stability problems. Accordingly, a built detergent composition of this invention can consist essentially of a polyelectrolyte builder as defined herein and an organic detergent surfactant in the ratios described above and the balance being a normally liquid vehicle medium, for example, water, a water-alcohol mixture, liquid nonionic surfactant compounds, etc. The vehicle, e.g. water, typically comprises from about 30–90 wt. percent, preferably 40–75 wt. percent of the total built liquid detergent formulator.

An additional advantage of this invention is that hydrotropes are not necessary in these light duty liquid detergents and therefore a more effective concentrated formulation can be prepared than previously possible.

In a finished detergent formulation of this invention there will often be added in minor amounts materials which make the product more effective or more attractive. The following are mentioned by way of example. Soluble sodium carboxymethylcellulose (CMC) can be added in minor amounts to inhibit soil redeposition. A tarnish inhibitor such as benzotriazole or ethylenethiourea can also be added in amounts up to about 2 percent. Fluorescers, perfume and color, while not essential in the compositions of the invention, can be added in amounts up to about 1 percent. An alkaline material or alkali such as sodium hydroxide or potassium hydroxide can be added in minor amounts as supplementary pH adjusters. There might also be mentioned as suitable additives, water, brightening agents, bleaching agents, sodium sulfate, and sodium carbonate.

Corrosion inhibitors can be added. Soluble silicates are highly effective inhibitors and can be added to certain formulas of this invention at levels of from about 3 percent to about 8 wt. percent. Alkali metal, preferably potassium or sodium, silicates having a weight ratio of $SiO_2$:$M_2O$ of from 1:1 to 2.8:1 can be used. M in this ratio refers to sodium or potassium. A sodium silicate having a ratio of $SiO_2$:$Na_2O$ of about 1.6:1 to 2.45:1 is especially preferred for economy and effectiveness.

In the embodiment of this invention which provides a built liquid detergent a hydrotropic agent may at times be found desirable. Suitable hydrotropes are water soluble alkali metal salts of toluene-sulfonate, benzenesulfonate, and xylenesulfonate. The preferred hydrotropes are the potassium or sodium toluenesulfonates. The hydrotrope salt may be added if so desired, at levels of 0 percent to about 12 wt. percent. While a hydrotrope will not ordinarily be found necessary, it can be added if so desired.

The specific action of the builders of this invention will vary to some extent, of course, depending upon the ratio of active detergent to builder mixture in any given detergent composition. There will be considerable variation in the strengths of the washing solutions employed by different users, i.e., some users may tend to use less or more of the detergent compositions than will others. Moreover there will be variations in temperature and in soil loads as between different washing operations. Further the degree of hardness of the water used to make up the washing solutions will also bring about apparent differences in the cleaning power and whiteness maintenance results. Finally, different fabrics will respond in somewhat different ways to different detergent compositions. The best type of detergent composition is one which accomplishes an excellent cleaning and whiteness maintenance effect under the most diverse cleaning conditions. The built detergent compositions of this invention are valuable in this respect.

DESCRIPTION OF THE PREFERRED EMBODIMENTS

The invention is further illustrated by the following examples.

EXAMPLE 1

A series of heavy duty solid detergents were formulated and were thereafter evaluated in cotton detergency tests. The formulations used were of the following type with only the builders being different from formulation to formulation.

| Heavy Duty Solid Formulation (% by weight) | |
|---|---|
| Surfactant-$C_{13}$ (average) linear alkyl benzene sulfonate | 10% |
| Builder | 15% to 30% |
| Sodium Meta Silicate | 5% |
| CMC | 1% |
| Sodium Sulfate | 39% |
| Water | Balance |
| Total | 100% |

The detergent formulations were tested in a commercial testing apparatus made by the U.S. Testing Company called the Terg-O-Tometer in order to measure the soil removal from the cotton fabric. The Terg-O-Tometer consists of four pots which can be operated simultaneously. Operating conditions can be varied, e.g., temperature, agitation, speed and duration of washing or rinsing.

Standard soiled cloths are available from a number of sources. In these tests, soiled cotton was employed. The procedure used was to cut the cloth into swatches of 3-½ by 4 inches. Four of these swatches were then placed in each pot. The pots were previously charged with one liter of water and a specified quantity of detergent (2.0 gram), and the agitators operated for a one minute period. The wash solution was maintained at 140° F. The swatches were washed for 10 minutes. At the conclusion of this period, the pots were removed from the apparatus, the solutions discarded, and the swatches wrung out by hand. The swatches were then returned to the pots which were recharged with one liter of water and (the swatches) were rinsed. The rinsing operation was continued for five minutes, after which the entire rinsing procedure was repeated. In both the washing and rinsing procedure, the water employed was deionized water doped with 120 ppm of calcium carbonate. At the end of the second rinsing, the swatches were ironed dry with care taken to avoid scorching the swatches.

Once dried, reflectance measurements of the swatches using a photovolt reflectometer with a search unit containing a green tristimulus filter were carried out. The reflectometer employed was manufactured by Photovolt Corporation, No. 610. The reflectometer was adjusted so that soiled cotton gave a reading of zero on the scale, while unsoiled cotton gave a reading of 100. The reading from the washed swatch thus is directly related to the percentage of soil removed.

All results reported are statistical averages. Each data point is the average of not less than 4 or more than 20 individual test swatches.

The chelating value of the various builders tested was ascertained by the following procedure. An amount equivalent to two grams of pure builder was accurately weighed and dissolved in 50 ml. of distilled water. Ten milliliters of 2 percent sodium oxalate indicator was added. The solution was then diluted with water to 250 mls. The pH was adjusted to 10 using 10 percent sodium hydroxide. The solution was then heated to 140° F. A small sample was withdrawn and used to adjust a spectrophotometer to 100 percent transmission at 550 m $\mu$. The sample was then returned to the solution being titrated. At this point 2 milliliter shots of titrant solution (calcium acetate) were added. Samples were withdrawn periodically and percent transmission taken, samples were then returned to the solution being titrated. During each cycle, pH was adjusted to 10 before the sample was removed to restore it to its initial pH. Equilibration was controlled with continuous agitation. The cycles were repeated until permanent and noticeable turbidity was observed. This was well past the endpoint. A plot of milliliters of calcium acetate added against percent transmission shows a sudden "break" at the end point. This enables calculation of end point.

Chelation value was calculated using the following formula:

$$\frac{(\text{ml.calcium acetate}) \times 25}{\text{sample weight, grams}} = \text{milligrams } CaCo_3 \text{ chelated per grams of chelating agent (chelating value)}$$

The results of the tests are summarized in Table I following.

TABLE I

| Builder(a) | Physical Properties Chelation Value(e) | Viscosity(b) (Centipoises) | Performance (% Reflectance) 15 wt.% Builder | 30 wt. % Builder |
|---|---|---|---|---|
| SNTA | 332 | — | 43 | 43.5 |
| STPP | 212 | — | 33 | 37 |
| Polyacrylate-A | 111 | 28 | 37 | 40.9 |
| Polyacrylate-B | 395 | 100 | 45 | 49 |
| Polyacrylate-C | 556 | 350 | 35 | 40.5 |
| Polyacrylate-D | 312 | 48 | 46.3 | 46.7 |

TABLE I-continued

| Builder(a) | Physical Properties Chelation Value(e) | Viscosity(b) (Centipoises) | Performance (% Reflectance) 15 wt.% Builder | 30 wt.% Builder |
|---|---|---|---|---|
| Polyacrylate-E | 287 | 55 | 43.9 | 45.2 |
| Polyacrylate-F | 319 | — | 34.7 | 29.9 |
| Polyacrylate-G | 440 | 200 | 40.1 | 40.3 |
| Polyacrylate-H | 128 | 61,300 | 29.4 | 31.4 |
| Polyacrylate-I | 388 | 110 | 39.5 | 50.7 |
| Polyacrylate-J | 285 | 60,000 | 42.6 | 51.3 |
| Polyacrylate-K | 60 | +100,000 | 29.7 | 29.9 |
| Polyacrylate-L | 223 | +100,000 | 33.7 | 41.1 |
| Polyacrylate-M | 124 | +100,000 | 31.4 | 39.4 |
| Polyacrylate-N | 175 | 7,400 | 25.8 | 35.6 |
| Polyacrylate-O | 51 | 388 | 23.4 | 37.4 |
| Polyitaconate | | 300(d) | 16 | 19 |
| Itaconate Copolymer-B(c) | | 715(d) | 40 | 43 |
| Itaconate Copolymer-C(c) | | 800(d) | 20 | 26 |
| Itaconate Copolymer-D(c) | | 1450(d) | 33 | 34 |

(a)All polymers were employed as the 100% sodium salt except for Polyacrylate-F which was a 100% ammonium salt.
(b)12.5 wt. % aqueous solution of the 100% salt of the polymer at 72°F.;
(c)Copolymers contain minor amounts of other monomers;
(d)Viscosity of a 25 wt. % polymer solid aqueous combination at 72°
(e)Milligrams of $CaCO_3$ chelated per gram of chelating agent.

As can be seen above in Table I, the preferred acrylic acid homopolymer of this invention (polyacrylic-B) performed outstandingly as compared to other builders used commercially and described in the art, such as the polyelectrolytes of U.S. Pat. No. 3,308,067.

A portion of the Table I data is also presented in the figure. From the figure it is evident that builder performance is not directly related to the chelation value of the builder. Builder performance diminished after a maxima was reached even with increasing polymer chelation value. Further, the figure shows that for polymers having a viscosity less than about 350 centipoises (A-E, G and I), builder performance declines markedly after the polymer viscosity exceeds about 200 centipoises.

EXAMPLE 2

It has been emphasized above that it is not now possible to use phosphate builders in light duty liquid dishwashing and hand laundry formulations. This is due to their alkalinity and resulting effects produced on the hands of those using the detergent. Polyacrylate and polymethacrylate salts have no such disadvantage as they can be utilized at lower pH ranges even though this cuts down on their overall performance.

A series of hand dishwashing tests and foam stability tests were run on various light duty liquid detergent formulations prepared from commercial builders, the builders of the invention and prior art builders.

The light duty detergents contained the following constituents:

| | % by weight |
|---|---|
| Surfactant-$C_{13}$ (average) linear alkyl benzene sulfonate | 25 |
| Foambooster (Super Amide) | 10 |
| Builder | 10 |
| Water | 55 |

-continued

| | % by weight |
|---|---|
| Total | 100% |

Foam stability and detergency evaluations of the various formulations were carried out according to the following procedures.

The hand dishwashing performance was measured in terms of the number of soild dishes required to break down the foam almost completely. Dishes were soiled with a standard soil made from Gold Medal Flour (50 percent), Spry (50 percent) and 0.05 percent Calcoflor White. The washing pan contained four liters of water and 0.5 grams detergent per liter of water. The wash solution temperature was maintained at 110° F.

It is necessary to allow the detergent to form the foam prior to use. This is done by pouring water of 150 ppm hardness through a funnel into the dishpan. The funnel is positioned at a height of 24 inches from the bottom of the dishpan. Each dish is allowed to soak in the washing solution for one minute and then washed with a dishcloth within a 20 second period, applying as equal an amount of pressure to each dish as possible. The point at which the complete breakdown of the suds occurred was noted. The dishwashing was still further continued until three consecutive dishes remained dirty. In other words, the dishwashing is continued until both points are obtained.

The detergency is measured by examining each dish under ultraviolet light to see how much area remained soiled. When more than 2 percent of the area remained soiled, this meant that the dish was not clean. Detergency in terms of the number of dishes having less than 2 percent area remaining uncleaned was recorded.

The results of the evaluations are shown in Table II following:

TABLE II

Comparison of Polyacrylate Na Salt Building Action with Polycarboxylates, TKPP and SNTA in Light Duty Hand Dishwashing Liquid Detergents

| Builder | Detergency-total no. of plates Total no.of plates washed | Detergency-total no. of plates Improvement over no builder | Foam Stability total no. plates Total no.of plates washed | Foam Stability total no. plates Improvement over no builder |
|---|---|---|---|---|
| TKPP | 4 | 2 | 11 | 2 |
| SNTA | 2 | 0 | 10 | 1 |
| Acrylic acid copolymer emulsion-A(a) | 2 | 0 | 12 | 3 |
| Acrylic acid copolymer emulsion-B(b) | 3 | 1 | 10 | 1 |
| Polyitaconate (c) | 3 | 1 | 10 | 1 |
| Itaconate Copolymer-B(c) | 4 | 2 | 14 | 5 |
| Itaconate Copolymer-C(c) | 3 | 1 | 11 | 2 |
| Polyacrylate-B(c) | 7 | 5 | 14 | 5 |
| No builder (Control) | 2 | — | 9 | — |

(a)Water emulsion of an acrylic acid copolymer containing 20 ± 0.5 wt. % solids and having a viscosity (as supplied) of 50 centipoises at 72°F.
(b)Water emulsion of an acrylic acid copolymer containing 20 ± 0.5 wt. % solids and having a viscosity (as supplied) of 250–300 centipoises at 72°F.
(c)See Table I polymer description From the above Table it can be seen that the acrylic acid homopolymer of the invention (Polyacrylate B) when used as a builder imparts outstanding detergency and foam stability to a light duty liquid detergent formulation.

What is claimed is:

1. A detergent formulation comprising a. an organic water soluble surfactant selected from the group consisting of anionic, nonionic, zwitterionic, ampholytic surfactants and mixtures thereof, and b. a polyelectrolyte builder comprising a water soluble salt of a homopolymer of an acid having the general formula:

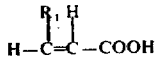

wherein $R_1$ is a hydrogen atom or methyl radical, said polyelectrolyte having a chelation value of at least about 75, the viscosity of a 12.5 wt. percent aqueous solution of the 100 percent sodium salt of said homopolymer at 72° F. being in a range of 25–350 centipoises, the weight ratio of said polyelectrolyte builder to said surfactant varying between about 1:5 to less than about 5:1.

2. The detergent formulation of claim 1 wherein $R_1$ is a hydrogen atom.

3. The detergent formulation of claim 1 wherein said water soluble salt of said homopolymer is a sodium salt.

4. The detergent formulation of claim 1 wherein the weight ratio of said polyelectrolyte builder to said surfactant varies from about 1:5 to 4:1.

5. A liquid detergent formulation comprising:

a. an organic water soluble surfactant selected from the group consisting of anoinic, nonionic, zwitterionic, ampholytic surfactants and mixtures thereof, b. a polyelectrolyte builder comprising a water soluble salt of a homopolymer of a acid having the general formula:

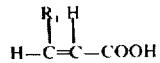

wherein $R_1$ is a hydrogen atom or methyl radical, said polyelectrolyte having a chelation value of at least about 75, the viscosity of a 12.5 wt. percent aqueous solution of the 100 percent sodium salt of said homopolymer at 72° F. being in a range of 24–350 centipoises, the weight ratio of said polyelectrolyte builder to said surfactant varying between about 1:5 to less than about 5:1, and c. from about 30 to 90 wt. percent water, based on total detergent formulation.

6. The detergent formulation of claim 5 wherein $R_1$ is a hydrogen atom.

7. The detergent formulation of claim 5 wherein said water soluble salt of said homopolymer is a sodium salt.

8. The detergent formulation of claim 5 wherein the weight ratio of said polyelectrolyte builder to said surfactant varies from about 1:5 to 4:1.

9. The detergent formulation of claim 6 wherein water comprises from about 40 to 75 wt. percent of the total formulation.

10. A detergent formulation consisting essentially of a. an organic water soluble surfactant selected from the group consisting of anionic, nonionic, zwitterionic, ampholytic surfactants and mixtures thereof, and b. a polyelectrolyte builder comprising a water soluble salt of a homopolymer of an acid having the general formula:

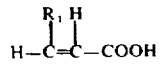

wherein $R_1$ is a hydrogen atom or methyl radical, said polyelectrolyte having a chelation value of at least 75, the viscosity of a 12.5 weight percent aqueous solution of the 100 percent sodium salt of said homopolymer at 72° C. being less than about 500 centipoises, the weight ratio of said polyelectrolyte builder to said surfactant varying between about 1:5 to less than about 5:1.

11. The detergent formulation of claim 10 wherein $R_1$ is a hydrogen atom.

* * * * *